US010487571B2

(12) United States Patent
Humma

(10) Patent No.: US 10,487,571 B2
(45) Date of Patent: Nov. 26, 2019

(54) PASS THROUGH ACCESS OPENING CLOSURE DEVICE

(71) Applicant: Shire Valley Design, LLC, Hamburg, PA (US)

(72) Inventor: Jeb A. Humma, Hamburg, PA (US)

(73) Assignee: Shire Valley Design, LLC, Hamburg, PA (US)

( * ) Notice: Subject to any disclaimer, the term of this patent is extended or adjusted under 35 U.S.C. 154(b) by 0 days.

(21) Appl. No.: 16/276,202

(22) Filed: Feb. 14, 2019

(65) Prior Publication Data

US 2019/0301236 A1 Oct. 3, 2019

Related U.S. Application Data

(60) Provisional application No. 62/648,724, filed on Mar. 27, 2018.

(51) Int. Cl.

| | |
|---|---|
| ***E06B 7/32*** | (2006.01) |
| ***E05B 65/08*** | (2006.01) |
| ***E05C 1/10*** | (2006.01) |
| ***E05F 11/54*** | (2006.01) |

(52) U.S. Cl.

CPC ..... *E06B 7/32* (2013.01); *E05B 65/0864* (2013.01); *E05B 65/0888* (2013.01); *E05C 1/10* (2013.01); *E05F 11/54* (2013.01); *E05Y 2900/132* (2013.01)

(58) Field of Classification Search

CPC ..... E06B 7/32; E06B 7/00; E06B 7/34; E05B 65/0864; E05B 65/0888; E05B 65/0017; E05C 1/10; E05C 7/00; E05C 7/002; E05F 11/54; E05Y 2900/132; E05G 7/00

USPC ..... 232/43.5, 43.4, 43.1, 44, 19, 1 E; 109/67, 68, 19; 49/68, 168; 220/476, 220/478, 479; 292/DIG. 46, 336.3, 259 R

See application file for complete search history.

(56) References Cited

U.S. PATENT DOCUMENTS

| | | | | |
|---|---|---|---|---|
| 845,964 | A * | 3/1907 | Mittendorf | G07F 9/06 232/1 R |
| 914,528 | A * | 3/1909 | Thinnes | B65F 1/12 232/43.5 |
| 952,173 | A * | 3/1910 | Zitko | B60N 3/083 220/477 |
| 5,921,191 | A * | 7/1999 | Gabel | E05G 7/005 109/13 |
| 6,302,325 | B1 | 10/2001 | Alexander | |
| 6,378,769 | B1 | 4/2002 | Wolgamot | |

(Continued)

*Primary Examiner* — William L Miller

(74) *Attorney, Agent, or Firm* — Miller Law Group, PLLC

(57) ABSTRACT

A closure device for a prison or hospital door having an access opening therethrough enables articles to be passed through the door without endangering the guard or hospital worker delivering the articles. The closure device includes a rectangular box having a top surface formed with a transparent panel, a hinged front access door, a vertically slidable rear access gate and an actuation mechanism for controlling the movement of the gate. The actuation mechanism has a pivoted actuator handle coupled to the rear gate to affect vertical movement thereof and a spring-loaded supplemental lock that requires release against a lock bar secured to the rear gate before the actuator handle can be moved. The rectangular box can have two opposing side walls or be formed with an open side that closes against a cover member secured to the door frame to close the open side of the box.

20 Claims, 15 Drawing Sheets

(56) References Cited

U.S. PATENT DOCUMENTS

| | | | | |
|---|---|---|---|---|
| 6,588,655 | B2 | 7/2003 | Stapleton, Jr. | |
| 6,598,546 | B2 | 7/2003 | Alexander | |
| 6,651,876 | B2 * | 11/2003 | Scott | E05B 65/0841 109/67 |
| 6,817,481 | B2 | 11/2004 | Alexander | |
| 9,016,558 | B2 | 4/2015 | Alexander | |
| 9,963,930 | B1 * | 5/2018 | Reisender | E06B 7/32 |

* cited by examiner

PASS THROUGH ACCESS OPENING CLOSURE DEVICE

CROSS-REFERENCE TO RELATED APPLICATIONS

This application claims domestic priority on U.S. Provisional Patent Application Ser. No. 62/648,724, filed on Mar. 27, 2018, the content of which is incorporated herein by reference.

FIELD OF THE INVENTION

This invention relates to a pass through device co-operable with an opening in a door to allow articles to pass safely through the otherwise impervious door. More specifically, the present invention relates to an access opening closure device for use in prisons and hospital psychiatric wards to allow articles, such as food, to be passed through the door into a cell or hospital room without exposing a guard or hospital attendant to possible injury or exposure.

BACKGROUND OF THE INVENTION

Doors for high security prison cells and also for some rooms housing dangerous psychiatric patients in hospitals or psychiatric facilities are typically provided with an access opening to allow the passage of food, medication or other materials through the door without requiring the door itself to be opened. This access opening is also used for handcuffing inmates before the door to the prison cell is opened by having the inmate reach through the access opening for the placement of handcuffs before unlocking the door and removing the inmate therefrom. Typically, the access opening is small in relation to the door and is covered by a hinged panel that is locked in a closed position to permit the hinged panel to be opened when access is desired. In such situations, whether in a prison setting or a psychiatric facility, once the hinged panel is opened, the person on the other side of the door now has direct access to the person on the other side of the locked door. Accordingly, the inmate or psychiatric patient may throw hazardous materials, such as human waste, through the opened access opening, or try to grab and injure the guard or hospital worker. Accordingly, prison guards and hospital workers are exposed to possible danger from the confined inmate or patient when direct access is available.

A number of attempts have been made to limit the direct exposure between the inmate of psychiatric patient and the guard or hospital worker, and thus protect the guards and hospital workers by providing an access opening closure device on the outside of the locked door over the access opening. One such device is found in U.S. Pat. No. 6,302,325, granted on Oct. 21, 2001; U.S. Pat. No. 6,598,546, granted on Jul. 29, 2003; U.S. Pat. No. 6,817,481, granted on Nov. 16, 2004; and U.S. Pat. No. 9,016,558, granted on Apr. 28, 2015, all of which were granted to Thomson Alexander. These Alexander devices all have a frame that is affixed to the outside of the door over the access opening for which the sliding panel is preferably removed, which supports a trapezoidal box having a pivoted top lid that allows access to the interior of the trapezoidal box. Once an article, such as food, is placed into the trapezoidal box, the slide panel for the device can be opened to allow the person on the inside of the cell or room to access the article and take position thereof.

If the top lid of the trapezoidal box is closed before the slide panel is opened, the inmate or psychiatric patient does not have direct access to the guard or hospital worker. The problem with the Alexander device is that the top lid and the slide panel have lock mechanisms associated with them to prevent movement unless the lock mechanisms are unlocked, but once unlocked an open top lid would expose the prison guard or hospital worker to danger from the inmate or patient on the opposing side of the wall. Operating the lock mechanisms can be cumbersome particularly when the guard or hospital worker is carrying a tray of food or other large article. In some cases, guards and hospital workers take shortcuts without reengaging the locks on the top lid and/or slide panel to facilitate the next operation to bring articles to the inmate or patient. Furthermore, with the hinge for the top lid being at the front of the pass through box, the top lid requires a significant amount of pivotal movement from the closed position thereof to the fully opened position to enable the placement of a tray of food into the trapezoidal box, and all of this weight on the hinge subjects the hinge to being damaged, resulting in higher maintenance costs.

A similar access opening closure device is disclosed in U.S. Pat. No. 6,378,769, granted on Apr. 30, 2002, to Steven Wolgamot, in which the box is rectangular and provided with a front hinged door. The box includes an overcenter clamping apparatus that allows the rectangular box to be portable from one door to another. In operation, the guard secures the rectangular box to the channel of the slide panel for the access opening by securing the latch mechanism to the channel and securing the overcenter latch. The front door can then be opened to insert a tray of food, as an example, into the rectangular box, after which the front door can be locked into a closed position. Then the slide panel is moved to allow the inmate on the opposing side of the door to remove the tray or other article. After the slide panel is locked in the closed position, the rectangular box can be unlatched from the channel of the slide panel to allow the rectangular box to be removed.

U.S. Pat. No. 6,588,655, granted to James Stapleton, Jr., on Jul. 8, 2003, discloses a non-contact food pass and access device similar to that described above with respect to U.S. Pat. No. 6,378,769. The Stapleton device also includes a rectangular box having a hinged front door and an overcenter clamping mechanism that engages the frame channel corresponding to the slide panel for the access opening through the door. In the Stapleton device, the rectangular box is shown as being co-operable with a guillotine style of slide panel in which the slide panel moves vertically rather than horizontally. The operation is substantially the same. The rectangular box is detachably connected to the frame channel of the slide panel through an overcenter clamping mechanism. The front door is opened to allow the insertion of a food tray, as an example, before the front door is closed and latched and then the slide panel moved to permit access to the interior of the rectangular box by the inmate.

All of these conventional access devices utilize a lock mechanism to control the movement of the slide panel and preferably also the door through which access to the interior of the box by the guard or hospital worker can be had. The more locks that are used, the more cumbersome the operation of the closure device becomes.

It would, therefore, be desirable to provide an access opening closure device that is simple to operate without compromising the safety and security of the person operating the closure device, and to provide a closure device that can be opened and closed in an instant, and a closure device that protects the prison guard or hospital worker when the pass through box is opened.

SUMMARY OF THE INVENTION

It is an object of this invention to overcome the disadvantages of the prior art by providing a closure device for mounting on a door having an access opening therethrough to provide the passage of articles through the door access opening while the door is closed.

It is another object of this invention to provide a closure device for a prison cell door in which articles to be delivered to an inmate can be passed to the inmate without exposing the guard to the inmate.

It is a feature of this invention that the closure device has a front access door and an independently operable rear access gate that permits one side of the closure device to be opened at any one time.

It is another feature of this invention that the front access door and the rear access gate can be selectively opened simultaneously.

It is an advantage of this invention that the articles can be delivered to a prison inmate or a hospital patient secured behind a locked door having an access opening formed in the door without exposing the guard or hospital worker to danger from the inmate or hospital patient.

It is another advantage of this invention that a prison inmate secured in locked cell cannot harm a guard while transferring articles, such as food, to the inmate.

It is still another object of this invention to provide a closure device for a prison cell door that can be operated to open one side of the closure device at a time.

It is still another advantage of this invention that transferring articles to a prison inmate can be accomplished with a low risk of injury to the prison worker.

It is still another feature of this invention that the closure device incorporates a supplemental locking mechanism that restricts the opening of the rear access gate.

It is another feature of this invention that the supplemental locking mechanism includes a spring-loaded pull handle that engages a lock bar affixed to the rear access gate to limit movement of the rear access gate.

It is another advantage of this invention that the rear access gate cannot be moved vertically while the rearwardly extending tip of the spring-loaded pull handle is engaged with the lock bar.

It is yet another feature of this invention that the rear access gate is connected to an actuation mechanism having a pivoted actuator handle that moves vertically to affect a corresponding vertical movement of the rear access gate.

It is yet another advantage of this invention that the actuator handle is connected directly to the rear access gate by pivoted links such that the vertical movement of the actuator handle results in a corresponding vertical movement of the rear access gate.

It is yet another object of this invention to provide a closure device for a door having the access opening formed at the side of the door so as to be open against the frame of the door.

It is a still another feature of this invention that the closure device can be formed with an open side for the rectangular box forming part of the closure device.

It is still another advantage of this invention that the missing side wall on the rectangular box can be substituted by a cover member mounted on the frame for the door such that the closure device closes against the cover member when the door is moved into a closed position.

It is yet another advantage of this invention that the open side of the rectangular box permits supplemental restraint devices secured to the prison inmate without requiring the guard to lose control of the supplemental restraint device which can pass through the open side of the rectangular box when the cell door is opened.

It is a further object of this invention to provide a closure device for a prison or hospital door having an access opening through the door to permit passage of articles through the door in which the closure device is durable in construction, inexpensive of manufacture, carefree of maintenance, easy to assemble, and simple and effective in use.

These and other objects, features and advantages are accomplished according to the instant invention by providing a closure device for a prison or hospital door having an access opening therethrough in which the closure device enables articles to be passed through the door without endangering the guard or hospital worker delivering the articles. The closure device includes a rectangular box having a top surface formed with a transparent panel, a hinged front access door, a vertically slidable rear access gate and an actuation mechanism for controlling the movement of the gate. The actuation mechanism has a pivoted actuator handle coupled to the rear gate to affect vertical movement thereof and a spring-loaded supplemental lock that requires release against a lock bar secured to the rear gate before the actuator handle can be moved. The rectangular box can have two opposing side walls or be formed with an open side that closes against a cover member secured to the door frame to close the open side of the box.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

DETAILED DESCRIPTION OF THE PREFERRED EMBODIMENT

Figure 8:
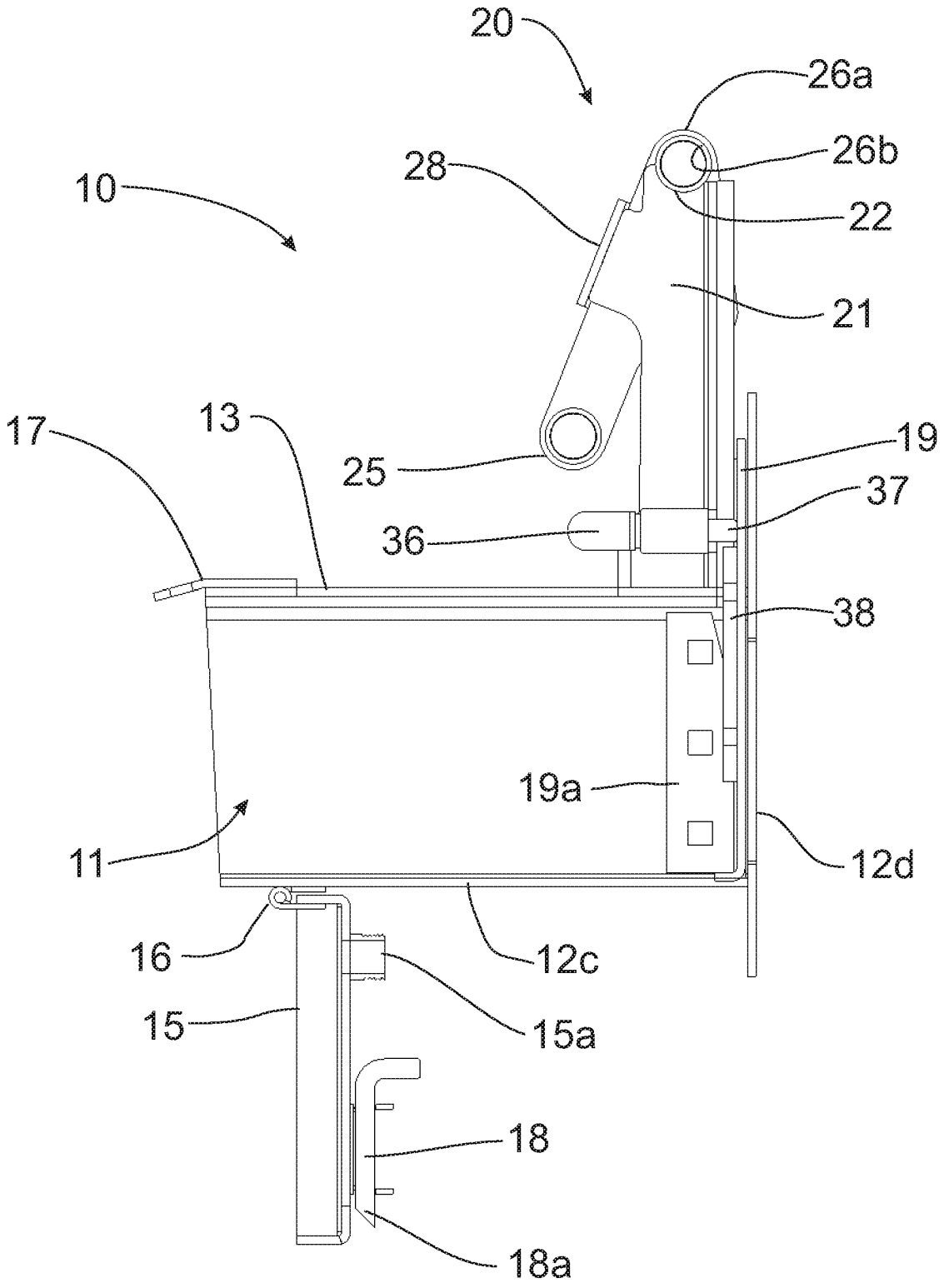
FIG. 8 is a left side elevational view of the cross-section shown in FIG. 6, but with the rear access gate being closed.
Figure 9:
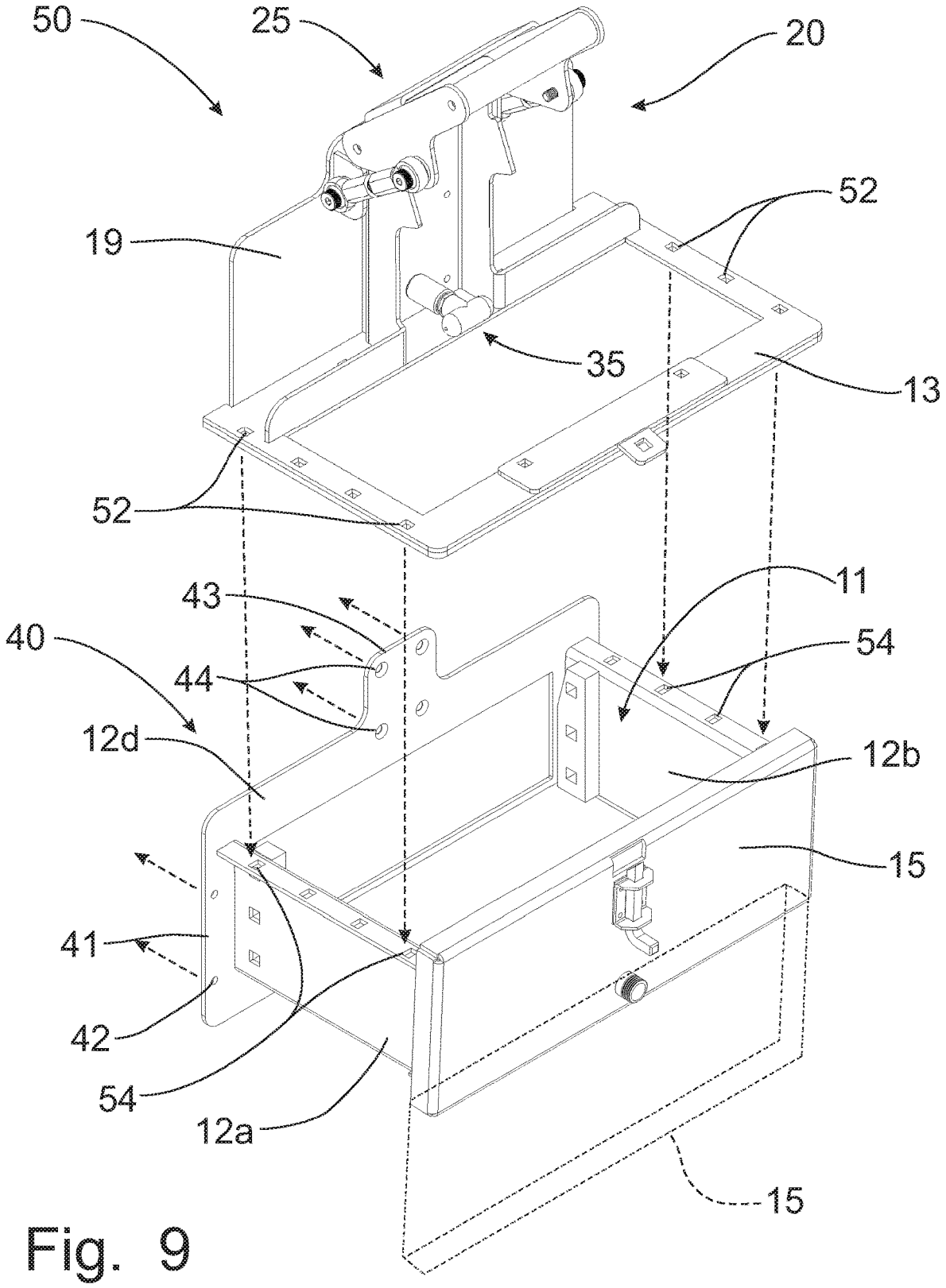
FIG. 9 is an exploded right, front perspective view showing the two major components of the access opening closure device depicting the installation of the access opening closure device onto a door provided with an access opening.
Figure 10:
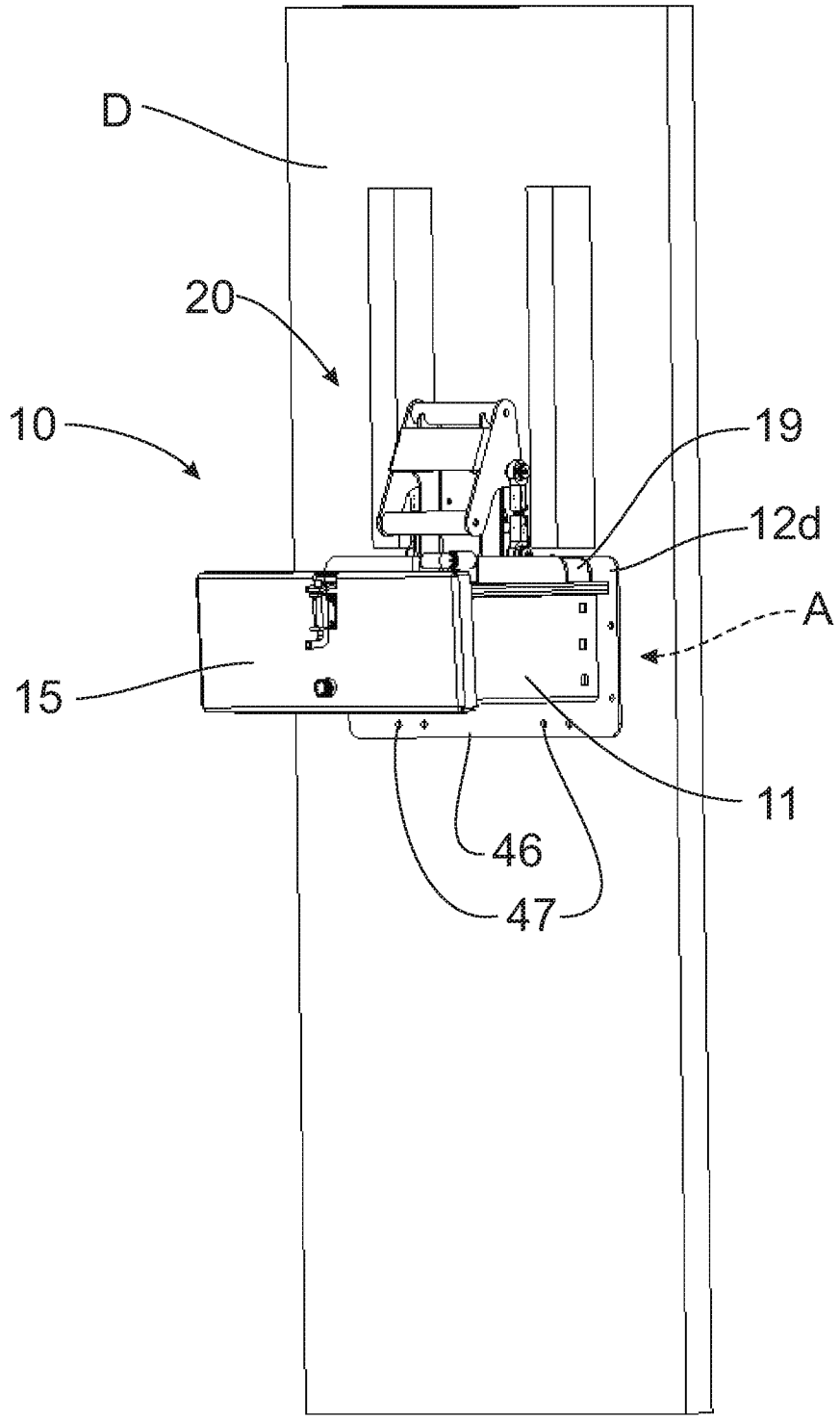
FIG. 10 is a left, front perspective view of the access closure device as depicted in FIG. 9 mounted on a door having the access opening formed in a central portion of the door.
Figure 11:
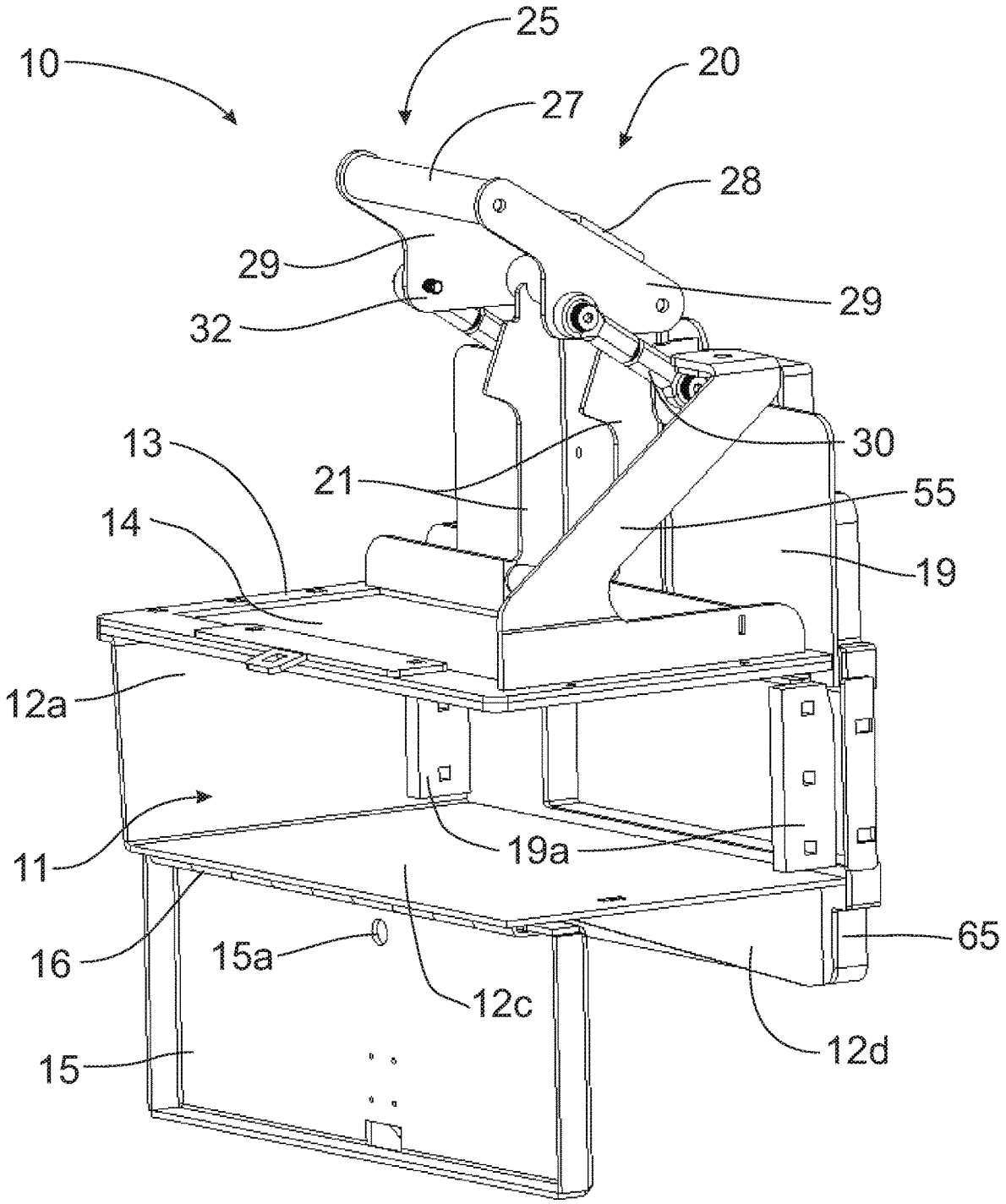
FIG. 11 is a left, front perspective view of a second embodiment of the access opening closure device in which the rectangular box is formed without a left vertical side wall, the access opening closure device being depicted with both the front access door and the rear access gate being moved into an opened position.
Figure 12:
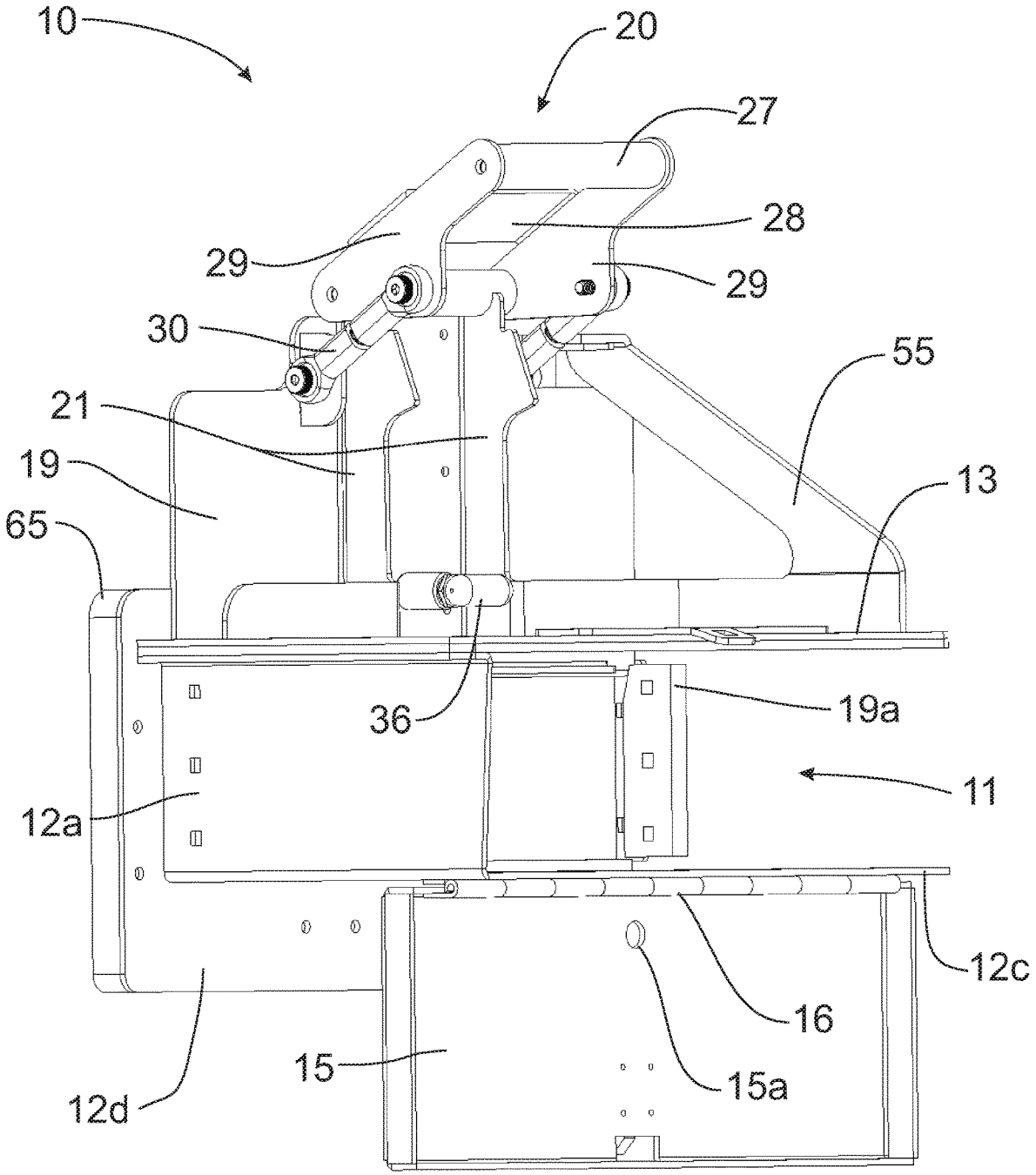
FIG. 12 is a right, front perspective view of the access opening closure device shown in FIG. 11.

Referring to FIGS. 1-10, a first embodiment of an access opening closure device incorporating the principles of the instant invention can best be seen. All references to left, right front and rear are made with respect to the hinged front access door being located at the front of the closure device. As shown in the drawings, the closure device 10 is formed, when assembled as described in greater detail below, as a rectangular box 11 defined by right and left vertical side walls 12*a*, 12*b*, a generally planar bottom member 12*c* that incorporates a hinged front door 15, a rear wall 12*d* oriented perpendicularly to the side walls, 12*a*, 12*b*, and a top member 13 that is formed with a transparent plastic insert 14. The rear wall 12*d* incorporates a vertically slidable rear access gate 19 at the rear of the closure device 10, and an actuation mechanism 20 that controls the movement of the rear access gate 19. As can be seen in FIG. 10, the closure device 10 is secured directly to a door D having an access opening formed centrally in the door D such that the closure member 10 is aligned with and covers the access opening with the rear access gate 19 being operable to control access into the rectangular box 11 through the access opening.

Figure 1:
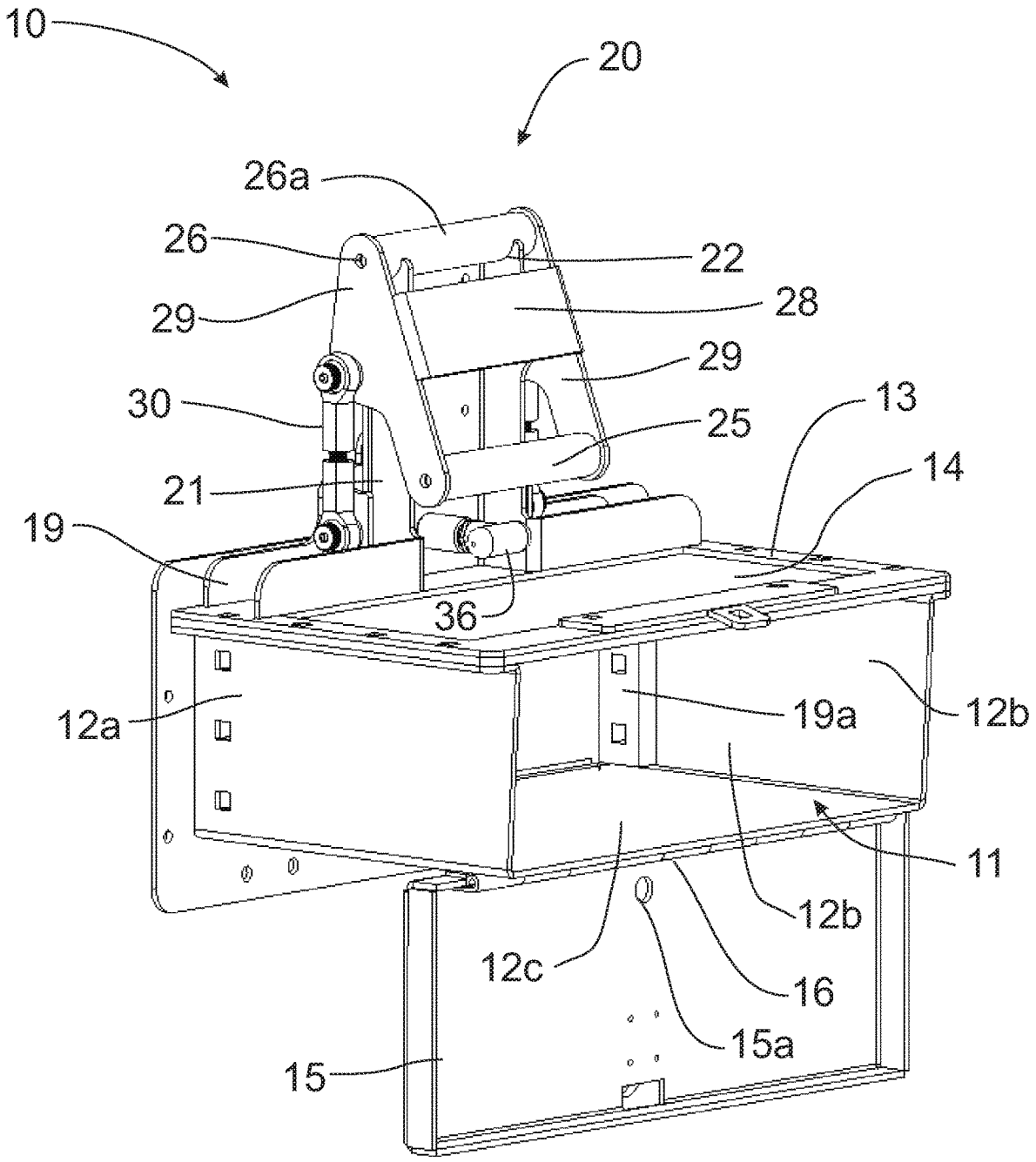
FIG. 1 is a right, front side perspective view of an access opening closure device incorporating the principles of the instant invention, the closure device is shown with the front access door opened and the rear access gate being closed.
Figure 2:
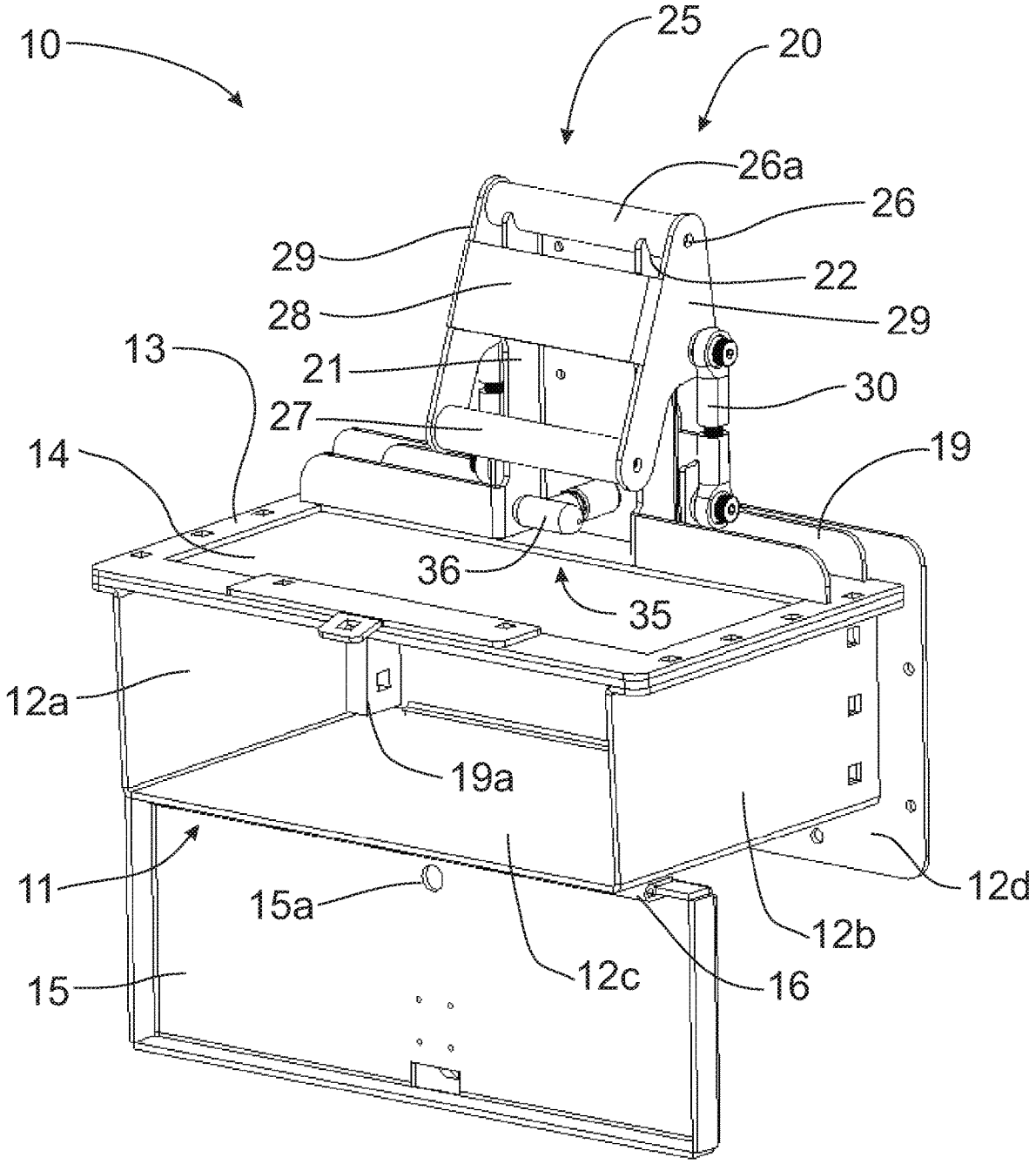
FIG. 2 is a left, front perspective view of the access opening closure device shown in FIG. 1.
Figure 3:
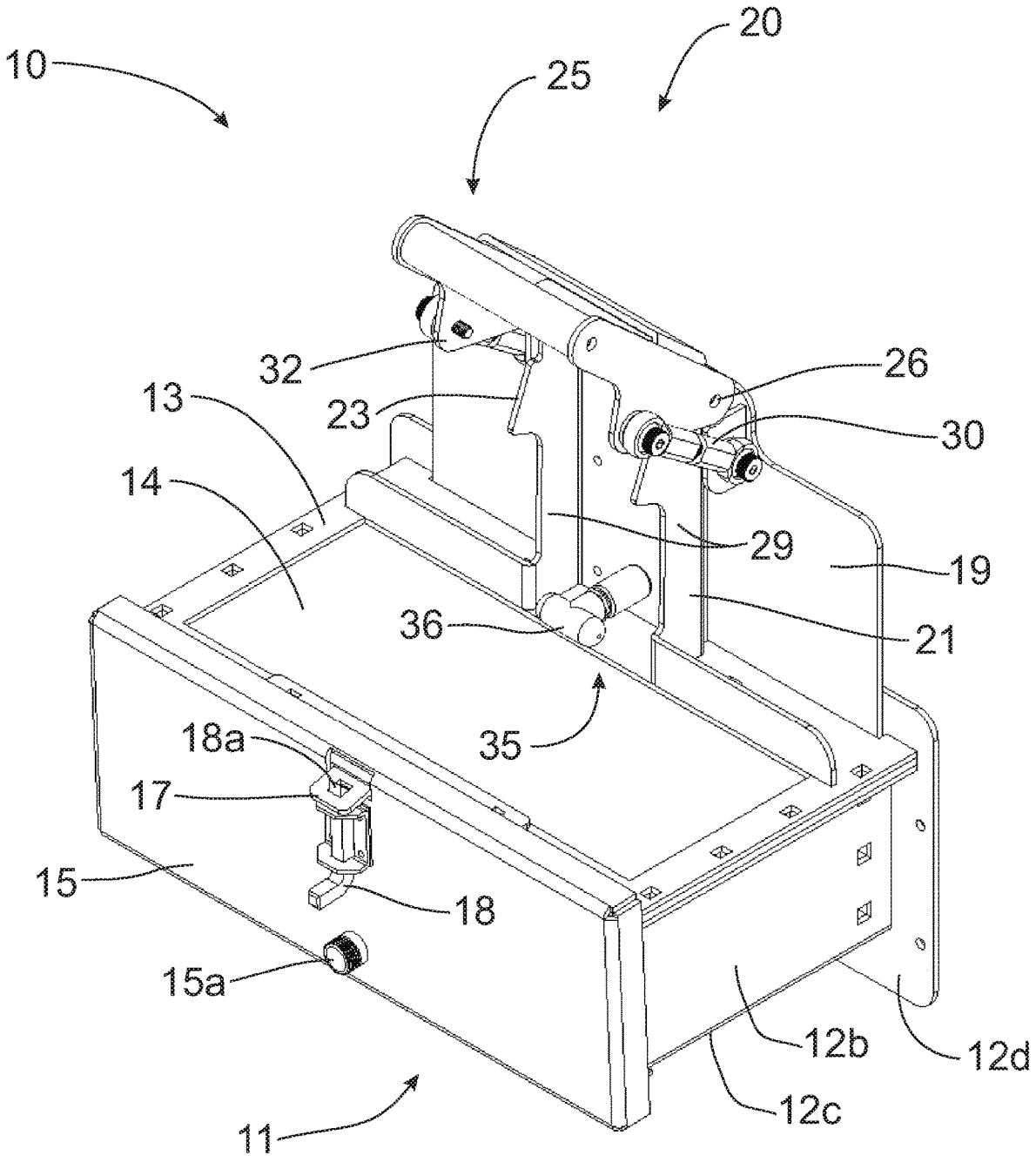
FIG. 3 is a left, front perspective view of the access opening closure device shown in FIG. 2, but having the front access opening closed and the rear access gate opened.
Figure 4:
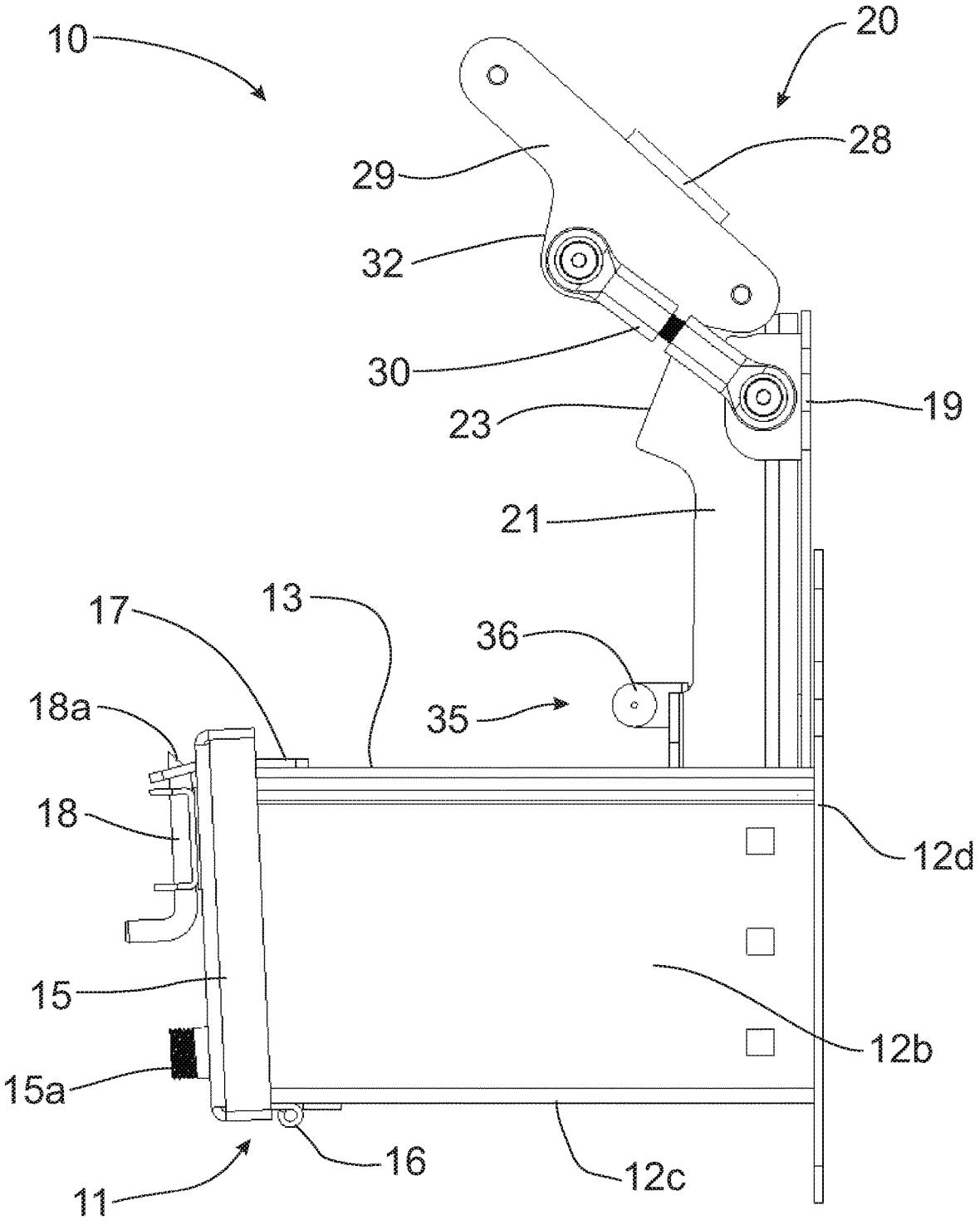
FIG. 4 is a left side elevational view of the access opening closure device shown in FIG. 3.
Figure 5:
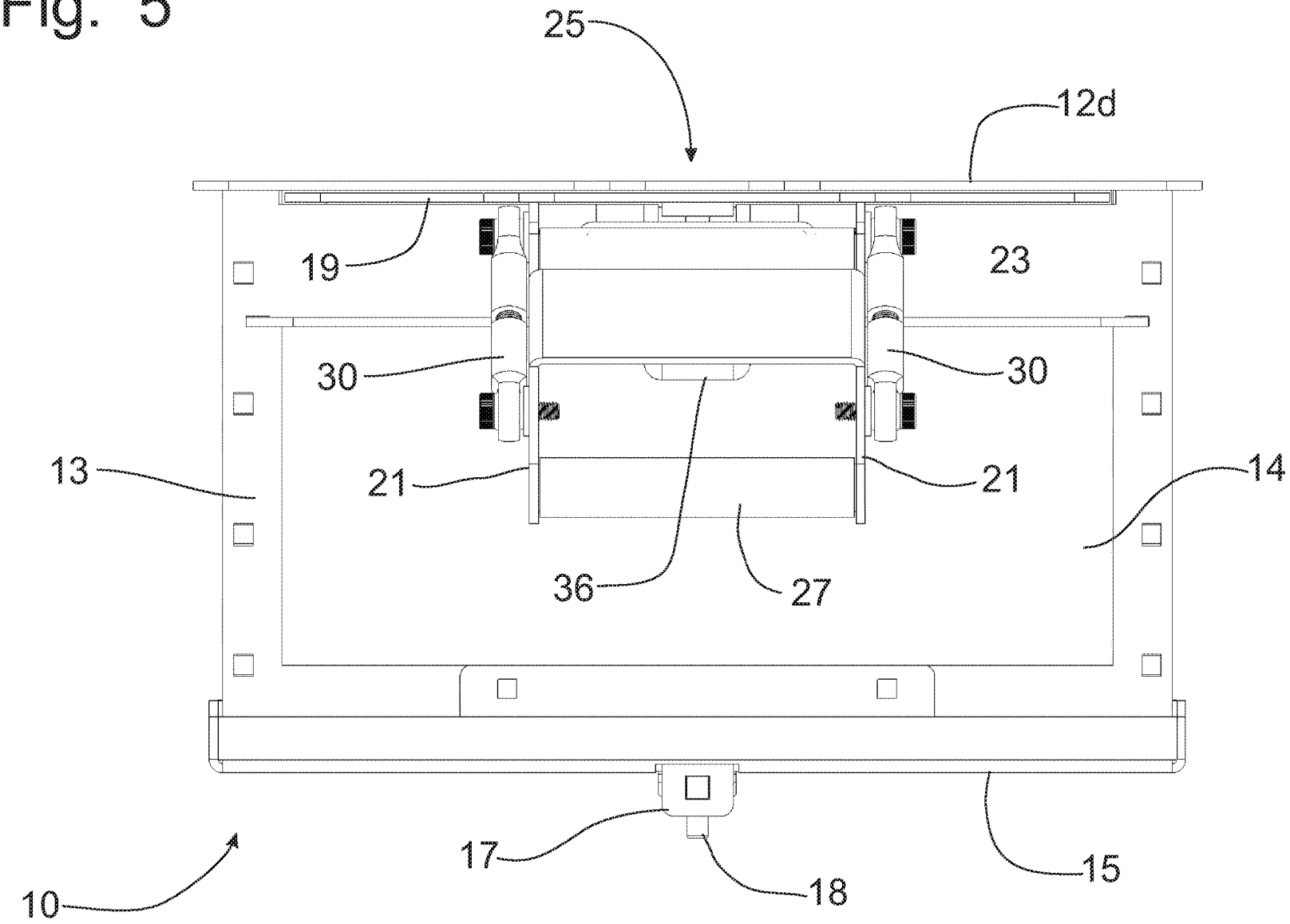
FIG. 5 is a top plan view of the access opening closure device shown in FIG. 3.

As seen in FIGS. 1-5, the front door 15 is pivotally connected to the bottom member 12*c* of the rectangular box 11 by a hinge 16 so that the front door 15 can be selectively pivotally moved between the opened position shown in FIGS. 1 and 2, and the closed position shown in FIGS. 3-5. The rectangular box 11 is formed with a hasp 17 that mates with a spring-loaded latch mechanism 18 mounted on the front of the front access door 15. When the latch mechanism 18 is engaged with the hasp 17, the latch mechanism secures the front access door 15 in the closed position. Preferably, the latch mechanism has a tapered member 18*a* that enables the latch mechanism 18 to automatically engage the hasp 17 when the front access door 15 is moved to the closed position. When the latch mechanism 18 is securely engaged with the hasp 17, the inmate or patient on the opposing side of the door D would not be able to force the front access door 15 into an opened position in which the guard or hospital worker would be exposed to direct contact from the inmate or patient.

The provision of the transparent panel 14 on the top portion 13 of the rectangular box 12 enables the guard or hospital worker to view whatever article that had been placed into the interior of the rectangular box 11 while being accessed by the inmate or patient. In addition, the front access door 15 can also be formed with a port 15*a*, that preferably is threaded and closable with an engaged cap, through which a defensive substance, such as pepper spray, can be discharged into the rectangular box 11.

Figure 7:
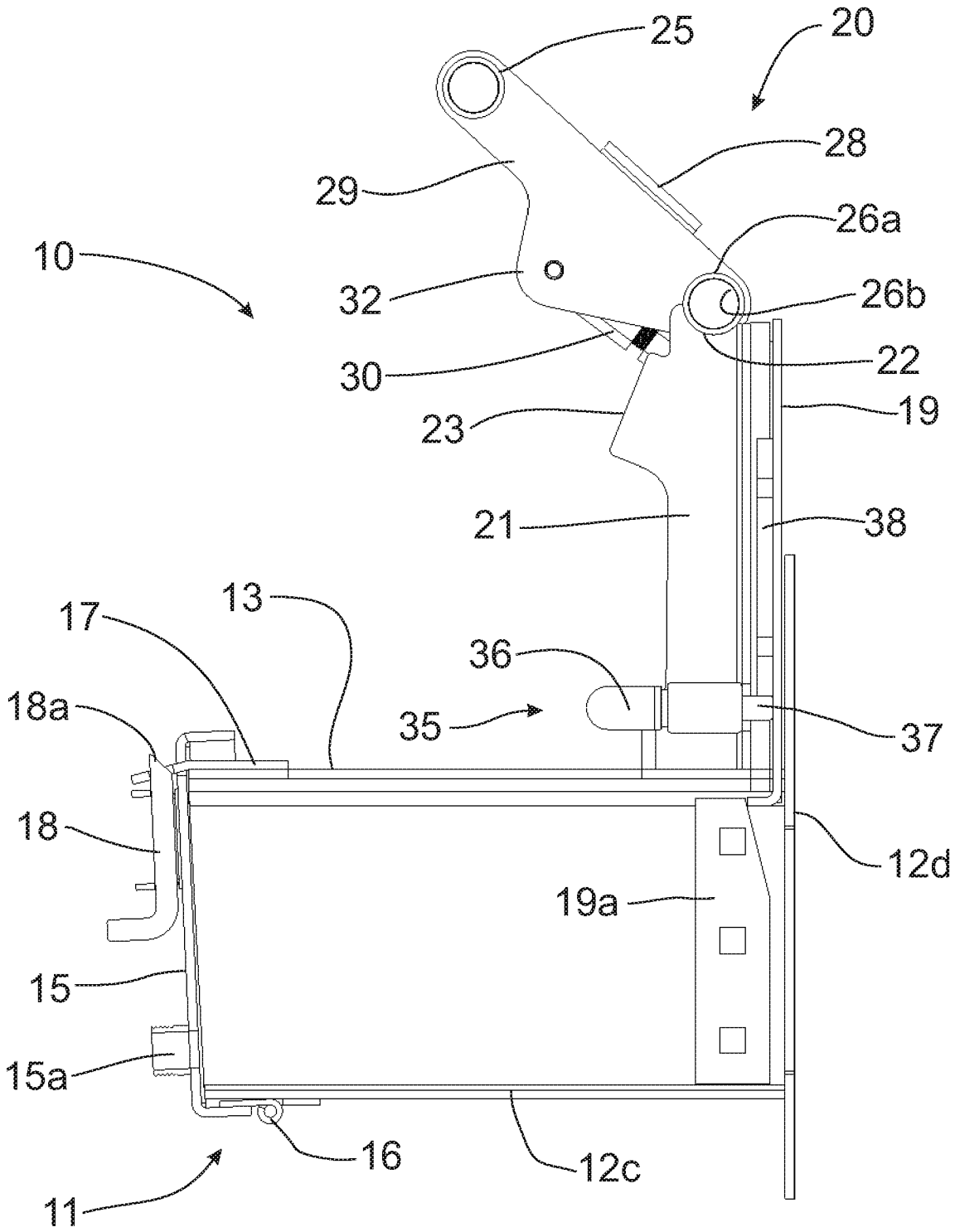
FIG. 7 is a left side elevational view of the cross-section shown in FIG. 6, but with the rear access gate being opened.

The closure device 10 incorporates a guillotine style of sliding rear access gate 19 that covers the access opening (not shown) in the door D. Preferably, the interior of the rectangular box 11 is formed with opposing rear guides 19*a* that guide the vertical movement of the rear access gate 19 and prevent the rear access gate 19 from being pushed into the interior of the box 11. Preferably, the rear gussets 19*a* are nylon or phenolic to facilitate the vertical movement of the rear access gate 19, and may be formed with a tapered surface at the upper portion thereof, as is depicted in FIG. 7, to help guide the movement of the rear access gate 19. The rear access gate 19 can be formed with an inwardly curved bends at the bottom edge to stiffen the slide panel 19 and to restrict vertical movement of the rear access gate 19 to prevent the rear access gate 19 from exiting the box 11.

The actuation mechanism 20 connects to the rear access gate 19 to affect vertical positioning thereof and, thereby, control access to the interior of the box 11 by the inmate or patient on the opposing side of the door D. The actuation mechanism 20 includes a pair of opposing frame members 21 that project vertically upwardly from the top member 13 of the rectangular box 11. Each of the opposing frame members 21 has a circular indentation or saddle 22 at the upper end thereof to receive the actuator handle 25 and an angled flat surface 23 that provide a stop for the movement of the actuator handle 25, as will be described in greater detail below. The actuator handle 25 includes a transverse pivot shaft 26, a transverse handle member 27 and a transverse flat stop member 28 connected between transversely spaced side frame members 29. The pivot shaft 26 includes a hollow bearing tube 26*a* affixed to the circular saddle indentations 22, such as by welding, and an internal pivot member 26*b* that passes through the hollow bearing tube 26*a* and connects to the side frame members 29 to provide a pivot axis for the movement of the actuator handle 25.

The side frame members 29 of the actuator handle 25 are connected to the rear access gate 19 by pivoting actuator links 30. The shape of each of the side frame members 29, as is best seen in FIG. 4, is such that a mounting extension 32 provides a location for mounting one end of the corresponding actuator link 30 that is offset to a line running between the pivot axis of the actuator handle 25 and the center of the handle member 27. As such, the movement of the actuator handle 25 into the closed position, as is depicted in FIGS. 1 and 2, can place the actuator link 30 into an over center orientation relative to the pivot axis 26*b*. When in such an orientation, any upward urging exerted on the rear access gate 19 will not result in an upward vertical movement of the rear access gate 19 until the actuator handle is moved out of the over center orientation.

Each of the actuator links 30 pivotally interconnect a corresponding one of the side frame members 29 and a mounting tab 33 welded to the rear access gate 19. Thus, when the actuator handle 25 is raised upwardly, the actuator handle 25 pivots about the pivot shaft 26 to move the actuator links upwardly with the pivoted side members 29 and, thereby draw the rear access gate 19 upwardly as well. With the movement of the rear access gate 19 being vertically linear, the ends of the actuator links 30 need to be capable of pivoting relative to their respective mountings. Once the rectangular box 11 is no longer being utilized and access thereto is to be terminated, the actuator handle 25 is pivoted downwardly until the stop member 28 reengages the angled flat surfaces 23 on the opposing frame members 21.

Figure 6:
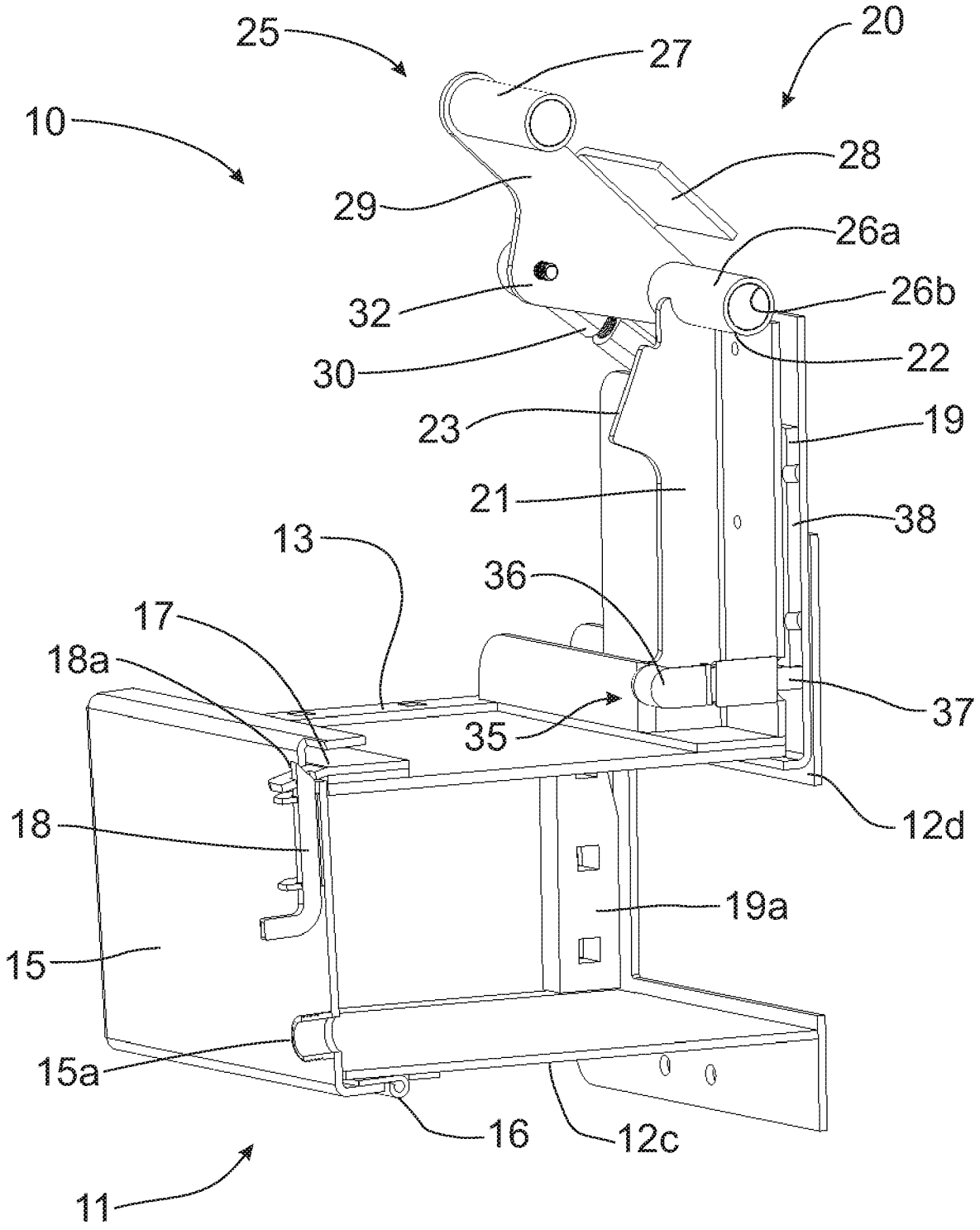
FIG. 6 is a left, front perspective view of a cross-section taken through the longitudinal center of the access opening closure device, with the rear access gate opened and showing the engagement of the locking apparatus.

Because of the sensitive nature of the use of these access opening closure devices 10, a supplemental lock mechanism 35 is preferably included in the construction of the closure device 10. As is depicted in all of the drawings, but is best seen in FIGS. 6-8, the supplemental lock mechanism 35 includes a spring-loaded pull handle 36 that is biased into engagement with the rear access gate 19. The pull handle 36 has a rearwardly projecting tip 37 that engages a lock bar 38 secured to the front surface of the rear access gate 19, such as by welding. The lock bar 38 is generally vertically oriented and is vertically movable with the rear access gate 19. The lock bar 38 has a vertical length dimension that corresponds to, but is slightly less than, the vertical movement of the rear access gate 19.

Figure 6A:
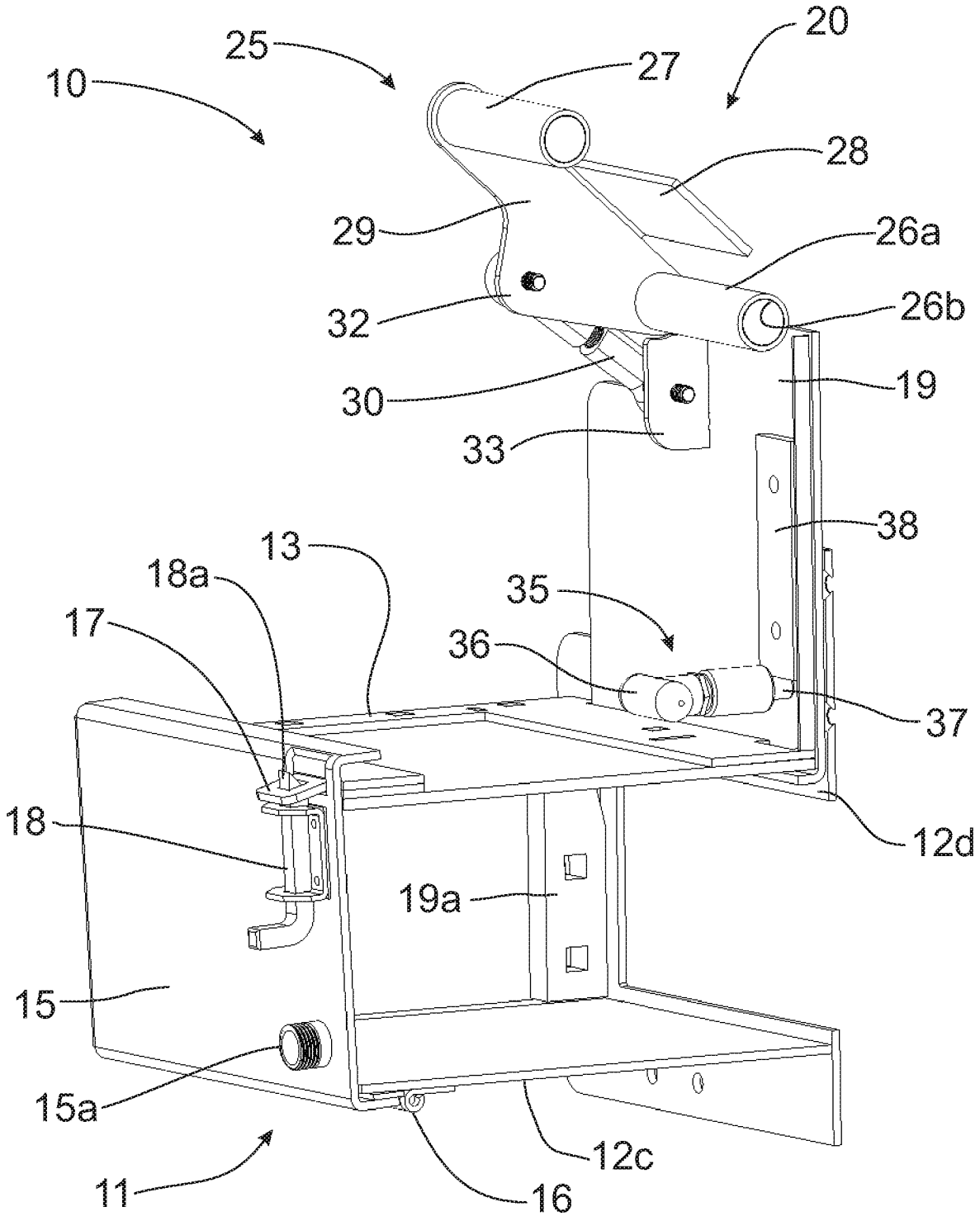
FIG. 6A is a left, front perspective view of a cross-section taken along a longitudinal vertical plane offset slightly from the view of FIG. 6, certain components of the frame and the gate actuation mechanism being removed for purposes of clarity to permit a view of the locking apparatus associated with the rear access gate.

Therefore, when the tip 37 of the spring-loaded pull handle 36 is positioned above the lock bar 38, the interference between the lock bar 38 and the tip 37 of the pull handle 36, as is depicted in FIG. 8, prevents the rear access gate 19 from moving upwardly. Similarly, when the tip 37 of the pull handle 36 is extended and positioned below the lock bar 38, the rear access gate 19 cannot move downwardly, as is depicted in FIGS. 6, 6A and 7.

Referring now to FIGS. 9 and 10, installation of the closure device 10 can be accomplished through the application of a number of fasteners connecting the closure device 10 to the door D. The rectangular box 11 can be formed as a single assembled bottom weldment 40 that includes, as the major components, the right side wall 12*a*, the left side wall 12*b*, the bottom wall 12*c*, the rear wall 12*d* and the hinged front access door 15. This weldment 40 can be connected to the door D onto which the closure device 10 is to be installed by inserting bolts (not shown) through the holes 42 formed in the laterally extending side flanges 41 on the back wall 12*d*, and through the holes 44 formed in the vertically extending mounting tab 43. The back wall 12*d* also includes a downwardly extending mounting flange 46 into which are formed fastener holes 47, best seen in FIG. 10, through which additional bolts should be inserted for engagement with the door D. In situations where the instant closure device 10 is replacing a previously installed prior art closure device the holes 44, 47 should align with the fastener holes used to mount the prior art closure device, but not the holes 42. The design is such that the holes 47 on the mounting flange 46 should align with the holes in the door D used to mount the previous closure device. However, the holes 42 on the laterally extending side flanges will require new holes to be drilled and tapped into the door D to mount the closure device 10.

Once the bottom weldment 40 is installed on the outside surface of the door D, the top assembled weldment 50 can be mounted on the bottom weldment 40. The top weldment would include the top member 13, including the transparent panel 14, the upwardly extending frame members 21, the rear access gate 19, the actuation mechanism 20 and the supplemental lock mechanism 35. As seen in FIG. 9, the top member 13 has a plurality of holes 52 formed therein along the laterally opposing flanges. These holes 52 align with corresponding holes 54 in flanges on the opposing right and left side walls 12*a*, 12*b*. Bolts (not shown) can be inserted through aligned holes 52, 54 and used to mount the top weldment 50 onto the bottom weldment 40. Once assembled, the closure device 10 is ready to be operated.

Referring now to FIGS. 11-14, a second embodiment of the closure device 10 incorporating the principles of the instant invention can best be seen. Most of the components described above with respect to the first embodiment are identical to the corresponding components found in the second embodiment, except as noted below. The only missing significant component of the second embodiment of the closure device 10 is the absence of the left side wall 12*b* (reference being made to the first embodiment of the closure device). To compensate for the lack of structural integrity that removing the left side wall would create, the top member 13 is provided with support bracing 55 that is not needed for the first embodiment. This support bracing is connected by fasteners or by welding to the lateral fringe of the top member 13 and to the back wall 12*d*. Additional structural support can be added to the underside of the bottom wall 12*c* if needed.

Figure 13:
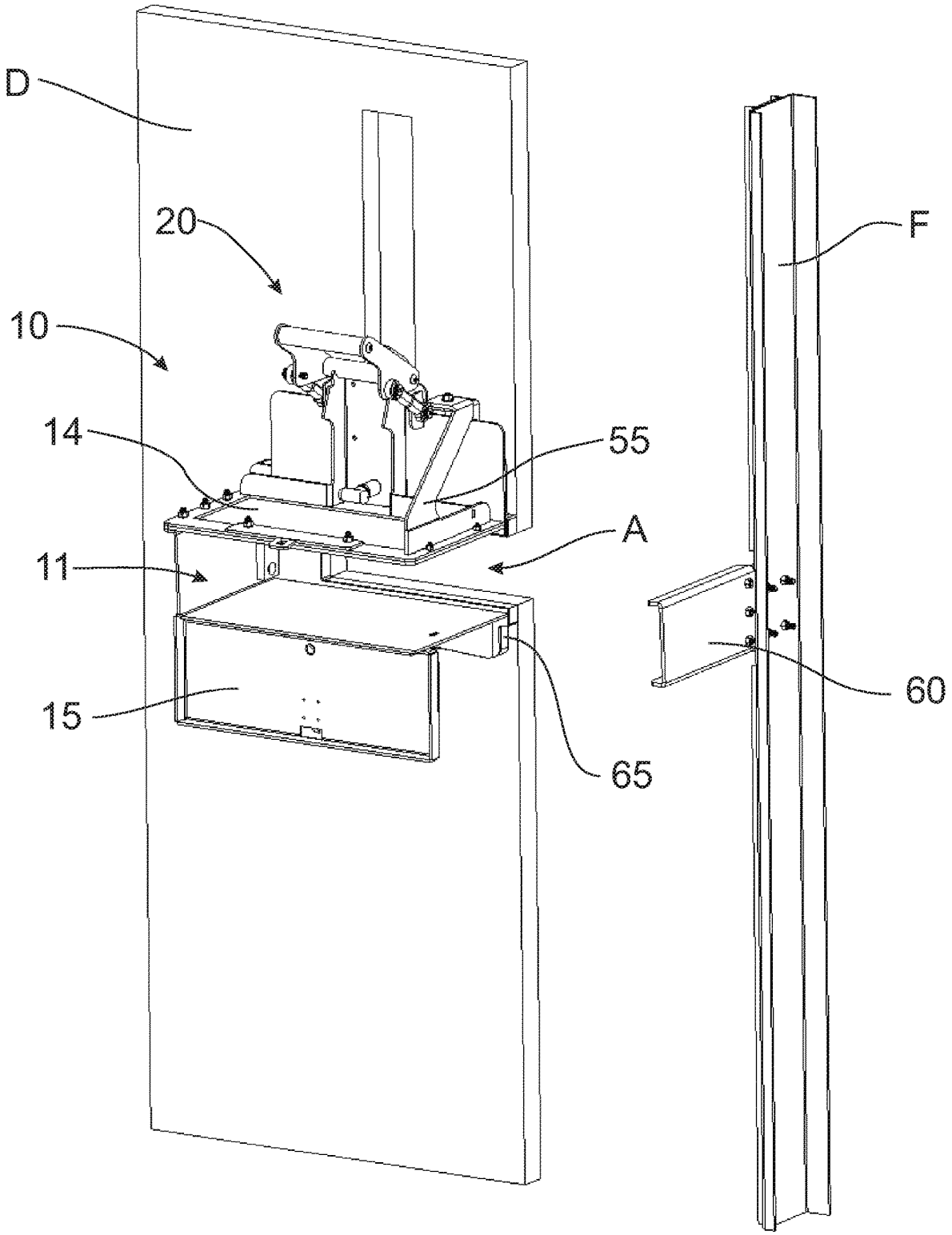
FIG. 13 is a left, front perspective view of the second embodiment of the access opening closure device being mounted on a door having the access opening formed at the side edge of the door, the door being shown in an opened position separated from the adjacent door frame.
Figure 14:
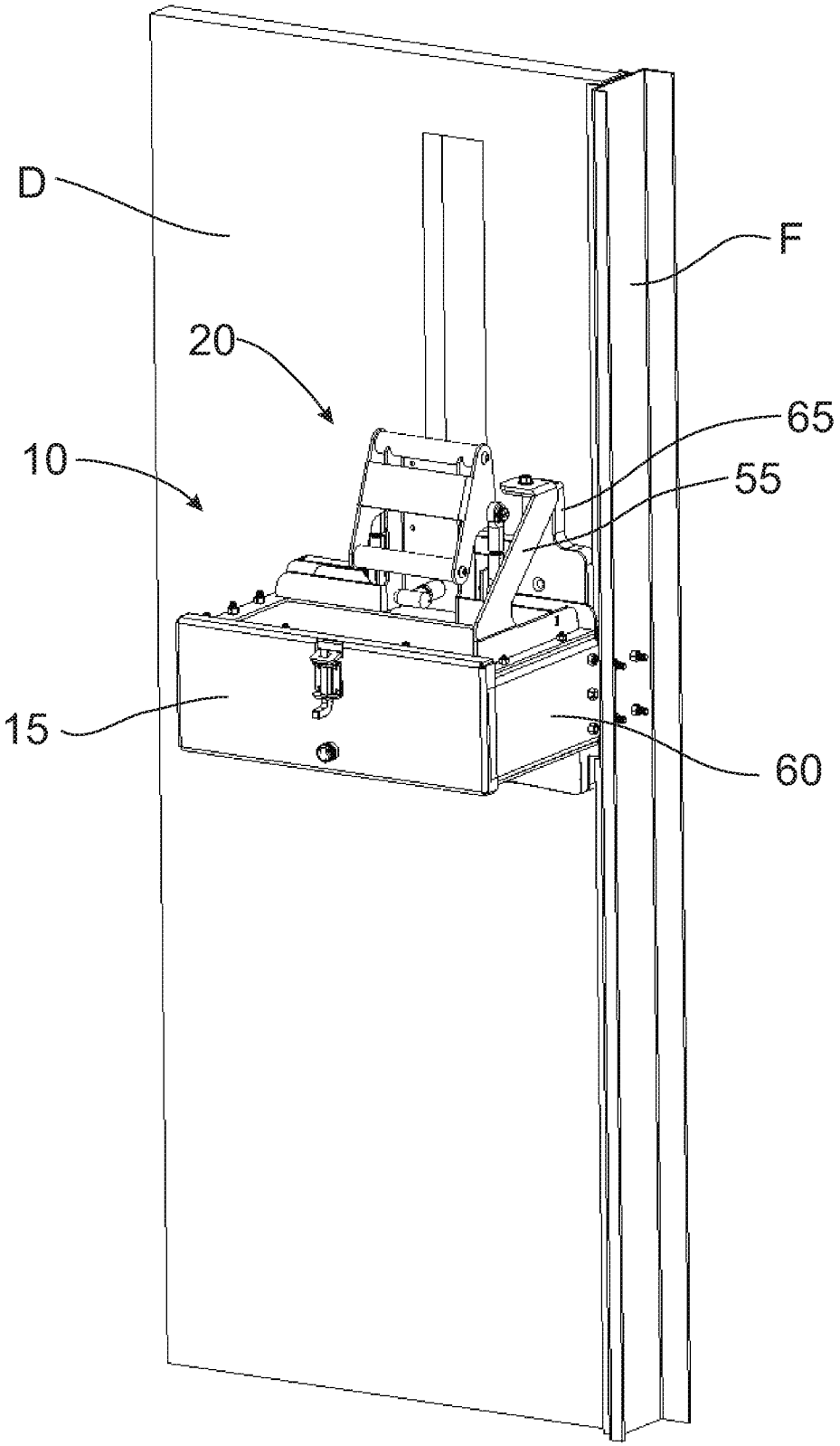
FIG. 14 is a left, front perspective view of the second embodiment of the access opening closure device mounted to the door as depicted in FIG. 13, but with the door moved to a closed position in which the adjacent door frame has mounted thereon a frame member filling the open left vertical side of the rectangular box.

As is best seen in FIG. 13, this second embodiment of the closure device 10 is utilized on doors D in which the access opening A is located at the side of the door, rather than at the center portion, as is depicted in FIG. 10. The frame F for the door has a cover member 60 fastened thereto by bolts or by welding that is positioned to align with the bottom weldment 40 and substitute for the missing left side wall when the door D is closed against the door frame F. Once the closure device 10 is properly positioned against the cover member 60, as shown in FIG. 14, the operation of the closure device 10 is identical to that described above with respect to the first embodiment of the invention.

An advantage of the second embodiment of the invention is that the hands of a prisoner can be cuffed and a supplemental restraint (not shown) be installed by opening both the front access door 15 and the rear access gate 19 to gain direct access to the inmate, and then when the door D is opened the supplemental restraint can pass through the opening in the rectangular box 11 corresponding to the missing left side wall 12*b* without losing control of the supplemental restraint. The inmate can then be under control as he leaves his cell through the opened door D, as depicted in FIG. 13.

In operation, the closure device 10 is mounted on the outside face of the door D in a manner that is secure and stable, covering the access opening A that is formed centrally in the door D or along the side of the door D. In the base position in which the access opening is closed from access by the inmate or patient on the opposing side of the door D, the slide plate 19 is lowered to close off the access opening, and the front access door 15 is closed against the rectangular box 11. The latch mechanism 18 engaged with the hasp 17 is engaged to prevent opening of the front access door 15 except from the outside exterior of the door D.

The guard or hospital worker first unlatches the latch mechanism restraining the front access door 15 and pulls the front access door 15 into the opened position, as depicted in FIGS. 1 and 2, by pivoting the front door 15 about the hinge 17. An article or article(s), such as a food tray (not shown), can be placed in the interior of the box 11 to rest on the bottom wall or floor 12*c*. The front access door 15 is then closed and preferably latched shut. With the transparent plastic panel 14 on the top portion 13 of the rectangular box 11, the guard or hospital worker can observe the article(s) placed into the interior of the box 11. The guard or hospital worker can first pull the spring-loaded pull handle 36 out of engagement with the lock bar 38 so that the actuation mechanism 20 can move freely. Then, grasping and raising the actuator handle 25 from the lowered position shown in FIG. 2, to the raised position shown in FIG. 3 directly raises the rear access gate 19 to open the access opening to the inmate who can access the article(s) placed in the rectangular box 11.

When the actuator handle 25 reaches the fully raised position, as shown in FIG. 3, the pull handle 36 can be released to insert the rearwardly extending tip 37 into engagement with the lock bar 38 at a position below the lock bar 38. This release of the pull handle 36 locks the rear access gate 19 in the raised position. When the article(s) has been removed from the rectangular box 11, or if the guard or hospital worker is going to retrieve some article placed into the rectangular box 11 by the inmate, the pull handle 36 is again pulled forwardly against the bias to release engagement of the tip 37 with the lock bar 38 to enable the lowering of the actuator handle 25 back to the position shown in FIG. 1. At this point, the inmate no longer has access to the interior of the rectangular box 11 and the guard or hospital worker can then open the front access door 15 to gain access to the interior of the rectangular box 11. If there is no concern that the inmate or patient will try to damage the closure device, the slide panel 19 can be maintained in the fully raised position so that the inmate or patient is able to return the article(s), such as a food tray, back into the rectangular box 12 through the opened access opening (not shown). Therefore, the transfer of article(s) between the guard or hospital worker and the inmate or patient can be accomplished without danger to the guard or hospital worker.

One skilled in the art will recognize that the closure device 10 can also be operable to provide a cuff pass, i.e. the procedure for handcuffing an inmate before removing him from his or her cell. Because the depth of the rectangular box 11 is approximately twelve inches from the front door 15 to the rear slide panel 19, a guard can open the slide panel 19 in the manner described above with the slide panel 19 latched in the upward, opened position and observe the inmate placing his hands through the access opening and through the rectangular box 11 to locate his hands near the front door 15. The guard can then open the front door 15 and place handcuffs on the inmate's wrists with little fear of injury from the inmate. Even if the inmate is able to grasp a guard's hand, the inmate's hands are so far extended into the rectangular box 11 that the inmate would have very little leverage to cause any injury to the guard, as the inmate's arms are inserted into the box up to his elbows and the height of the box 12 between the floor 18 and the top surface 13, thus minimizing the potential for causing injury to the guard.

The cuff pass is made a little easier with use of the second embodiment shown in FIGS. 11-14 in that the cuffed hands of the inmate can be supplemented by a supplemental restraint device that is retained within the guard's hands. Then, the cell door D can be opened, which opens the left side of the rectangular box 11 with the disengagement of the cover member 60 on the door frame F, allowing the supplemental restraint device to pass through the open side of the rectangular box 11 without exposing the guard to the inmate. The reverse procedure can be used to remove the supplemental restraint device and the cuffs by allowing the supplemental restraint device to pass through the open side of the rectangular box 11 until positioned internally of the rectangular box 11, whereupon the door D can be closed without the guard losing control of the supplemental restraint device.

One skilled in the art will also recognize with respect to FIGS. 11-14 that the closure device 10 is also provided with an optional spacer 65 to space the rear wall **12*d* away from the door D in order to obtain a proper fit with the door D in situations where the access opening A or the window or windows formed in the door D have reinforcing brackets extending around the perimeter, or where bolt heads project outwardly from the door D to interfere with a tight fit of the rear wall 12*d* to the door D. Preferably, the spacer 65 is formed of a plastic material, such as ultra-high molecular weight polyethylene (UHMW), which is cut and shaped to match the shape of the rear wall 12*d* and then placed between the rear wall 12*d* and the exterior face of the door D. This optional spacer 65 can also be used in conjunction with the first embodiment of the access opening closure device 10 shown in FIGS. 1-10**.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. For example, the size and shape of the closure device 10, or the components thereof, including the rectangular box 11, and the actuation mechanism 20, can be formed in multiple shapes and/or sizes to accommodate the needs or desires of the purchaser of the closure device 10.

Having thus described the invention, what is claimed is:

1. An access opening closure device for mounting on a door having an access opening formed therein to permit articles to be passed through the door in a safe manner, comprising:

a box affixed to said door to cover said access opening, said box including a floor, a top surface, a front access door, a rear access gate positioned proximate to said access opening, and an actuation mechanism operably connected to said rear access gate to control the movement thereof relative to said access opening;

said rear access gate being selectively vertically movable relative to said front access door to open and close the access opening; and said actuation mechanism having an actuator handle that is operable to affect said vertical movement of said rear access gate; said actuation mechanism including a supplemental lock mechanism that restricts operation of said actuator handle.

2. The closure device of claim 1 wherein said actuator handle is pivotally mounted on frame members for vertical pivotal movement to affect vertical movement of said rear access gate.

3. The closure device of claim 2 wherein said actuation mechanism further includes a pair of laterally spaced actuator links pivotally interconnecting said actuator handle and said rear access gate so that the raising of said actuator handle causes the corresponding raising of said rear access gate.

4. The closure device of claim 3 wherein said supplemental lock mechanism comprises:

a spring-loaded pull handle biased rearwardly toward said rear access gate;

a lock bar affixed to said rear access gate and facing forwardly toward said pull handle, said pull handle having a rearwardly extending tip engagable with said lock bar to restrict movement of said lock bar vertically.

5. The closure device of claim 4 wherein said rearwardly extending tip is positionable above said lock bar when said rear access gate is in a fully lowered position, and positionable below the lock bar when said rear access gate is in a fully raised position.

6. The closure device of claim 4 wherein said front access door is pivotally connected to said box through a hinge to permit movement of said front access door between an opened position and a closed position, said front access door including a latch mechanism operable to secure said front access door in said closed position.

7. The closure device of claim 6 wherein said front access door includes a port that can be opened to the interior of said box when said front access door is in said closed position.

8. The closure device of claim 4 wherein said box is rectangular in shape and includes said floor, said top surface and opposing laterally spaced side walls, said top surface incorporating a transparent panel to permit viewing of the interior of said rectangular box.

9. The closure device of claim 4 wherein said box is rectangular in shape and includes said floor, said top surface and one side wall interconnecting said floor and said top surface, said closure device further having a second side wall mounted on a frame for said door, said closure device being mounted on a side portion of said door so that the closing of said door against said frame places the rectangular box into engagement with said second side wall.

10. The closure device of claim 9 wherein said top surface is provided with a support brace to enhance the structural integrity of the rectangular box.

11. A closure device for a door having an access opening formed therein for passage of articles through said door while allowing said door to remain closed against a frame supporting said door, comprising:

a box affixed to said door to enclose said access opening, said box including a floor, a top surface, a front access door connected to said floor, a rear access gate positioned proximate to said access opening, and an actuation mechanism operably connected to said rear access gate to control the movement thereof relative to said access opening;

said rear access gate being vertically movable relative to said front access door to open and close the access opening; and said actuation mechanism having an actuator handle that is operable to affect said vertical movement of said rear access gate.

12. The closure device of claim 11 further comprising a supplemental lock mechanism associated with the actuation mechanism to restrict movement of said actuator handle.

13. The closure device of claim 12 wherein said supplemental lock mechanism comprises:

a spring-loaded pull handle having a rearwardly extending tip; and a lock bar affixed to a forward side of said rear access gate to cooperate with said rearwardly extending tip and selectively restrict movement of the rear access gate until the rearwardly extending tip is disengaged from said lock bar.

14. The closure device of claim 12 wherein said actuator handle is pivotally mounted on frame members and is interconnected to said rear access gate by pivoted actuator links.

15. The closure device of claim 14 wherein said box is rectangularly shaped and formed with said floor, said top member and at least one side wall interconnecting said floor and said top member, said front access door being movable to selectively close a front portion of said box and said rear access door being movable to selectively close a rear portion of said box with respect to said access opening.

16. The closure device of claim 15 wherein said box has one open side that closes against a cover member mounted on a frame for said door when said door is moved to a closed position.

17. A closure device for a door provided with an access opening therethrough for the passage of articles from one side of the door to another while the door remains closed, comprising:

a first weldment having a horizontal floor, a vertical back wall perpendicular to said floor, at least one vertical side wall perpendicular to both said floor and said back wall, said back wall being formed with an opening therein alignable with said access opening and with flanges having holes therethrough for the passage of fasteners securing said back wall to said door, said floor having a front access door connected thereto and movable between an opened position and a closed position; and a second weldment having a top member formed with a transparent panel therein and peripheral flanges having openings therethrough for the passage of bolts connecting at least one of said peripheral flanges to a corresponding support flange on said at least one vertical side wall, said second weldment further including a vertically slidable rear access gate and an actuation mechanism connected to said rear access gate to control the vertical movement of said rear access gate, said second weldment being mounted on said first weldment by fasteners interengaging said peripheral flanges and said at least one support flange.

18. The closure device of claim 17 wherein said actuation mechanism comprises:

a pivoted actuator handle connected to said rear access gate by opposing pivotable actuator links for movement in a vertical direction causing a corresponding vertical movement in said rear access gate; and a supplemental lock mechanism including a spring-loaded pull handle having a rearwardly extending tip engagable with a lock bar affixed to a front side of said rear access gate to restrict vertical movement of said actuator handle and said rear access gate.

19. The closure device of claim 18 wherein said front access door is pivotally connected to said floor by a hinge, said front access door carrying a latch mechanism that selectively secures said front access door to said top member, said front access door also including a port open to an interior portion of said first weldment, said port being associated with a cap to open and close said port.

20. The closure device of claim 19 wherein said first weldment has one open side that closes against a cover member mounted on a frame for said door when said door is moved to a closed position.

* * * * *